US009398383B2

(12) United States Patent
Johansen

(10) Patent No.: US 9,398,383 B2
(45) Date of Patent: Jul. 19, 2016

(54) BATTERY ASSEMBLY FOR A HEARING DEVICE AND ASSOCIATED METHOD

(71) Applicant: GN ReSound A/S, Ballerup (DK)

(72) Inventor: Jan Johansen, Koge (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 14/538,598

(22) Filed: Nov. 11, 2014

(65) Prior Publication Data

US 2015/0131833 A1 May 14, 2015

(30) Foreign Application Priority Data

Nov. 12, 2013 (DK) ..... 2013 70671
Nov. 12, 2013 (EP) ..... 13192513

(51) Int. Cl.
*H04R 25/00* (2006.01)
*H04R 1/10* (2006.01)

(52) U.S. Cl.
CPC ..... *H04R 25/602* (2013.01); *H04R 1/1025* (2013.01); *H04R 25/556* (2013.01); *H04R 25/65* (2013.01); *H04R 2225/31* (2013.01)

(58) Field of Classification Search
CPC .... H04R 1/1025; H04R 25/55; H04R 25/556; H04R 25/602; H04R 2225/021; H04R 2225/023; H04R 2225/025; H04R 2225/31; H04R 2225/61
USPC ..... 381/314, 322, 323, 324, 328, 330, 331; 320/107, 108
See application file for complete search history.

(56) References Cited

U.S. PATENT DOCUMENTS

| | | | | |
|---|---|---|---|---|
| 4,379,988 | A | 4/1983 | Mattatall | |
| 6,658,124 | B1 * | 12/2003 | Meadows | 381/323 |
| 7,414,380 | B2 * | 8/2008 | Tang et al. | 320/108 |
| 7,944,171 | B2 | 5/2011 | Yeh | |
| 2002/0113572 | A1 | 8/2002 | Zink et al. | |
| 2008/0009918 | A1 | 1/2008 | Zierhofer et al. | |
| 2012/0033839 | A1 | 2/2012 | Lee et al. | |
| 2013/0127404 | A1 | 5/2013 | Maenpaa | |

FOREIGN PATENT DOCUMENTS

| | | | |
|---|---|---|---|
| DE | 20 2008 016 136 | U1 | 3/2009 |
| EP | 2 503 796 | A1 | 9/2012 |
| WO | WO 03/105308 | A1 | 12/2003 |

OTHER PUBLICATIONS

Extended European Search Report dated Apr. 2, 2014, for related EP Patent Application No. 13192513.3, 5 pages.
First Technical Examination and Search Report dated Jun. 26, 2014 for related DK Patent Application No. PA 2013 70671, 4 pages.

* cited by examiner

*Primary Examiner* — Huyen D Le
(74) *Attorney, Agent, or Firm* — Vista IP Law Group, LLP; Gerald Chan

(57) ABSTRACT

A battery assembly for powering a hearing device includes: a main part having at least a first surface and a second surface, the main part comprising a first electrode formed as an inductive coil; a first attachment member on at least a primary part of the first surface for attaching the main part to a hearing device housing of the hearing device; a second attachment member for attaching a direct current source to the main part; and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current.

17 Claims, 6 Drawing Sheets

BATTERY ASSEMBLY FOR A HEARING DEVICE AND ASSOCIATED METHOD

RELATED APPLICATION DATA

This application claims priority to and the benefit of Danish Patent Application No. PA 2013 70671, filed on Nov. 12, 2013, pending, and European Patent Application No. 13192513.3, filed on Nov. 12, 2013, pending. The entire disclosures of both of the above applications are expressly incorporated by reference herein.

FIELD

The present disclosure relates to a battery assembly for a hearing device, and in particular to a battery assembly for wirelessly powering a hearing device.

BACKGROUND

With the developments in rechargeable battery technology, hearing devices with rechargeable batteries that can be charged by wire or wirelessly are emerging. A hearing device user is required to recharge the hearing device regularly during periods where the hearing device is not in use, e.g. during the night or other non-use periods, where the hearing device is detached from the user and turned off. If a user forgets to recharge the hearing device and the battery runs out, the user is required to detach the hearing device and place in a charger for recharging the battery before being able to use it. This is inconvenient and may reduce user friendliness.

SUMMARY

There is a need for devices and methods that improves the user friendliness of a hearing device with rechargeable batteries, in particular wirelessly rechargeable batteries.

Accordingly, a battery assembly for powering a hearing device is provided. The battery assembly comprises a main part having at least a first surface and a second surface and comprising a first electrode formed as an inductive coil; a first attachment member on at least a primary part of the first or second surface for attaching the main part to a hearing device housing of the hearing device. The battery assembly comprises a second attachment member for attaching a direct current source to the main part; and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current in the inductive coil.

Further, a method for powering a hearing device with a direct current source is provided. The method comprises: providing a battery assembly as described herein; attaching a direct current source to the main part of the battery assembly; and activating the direct current source.

The battery assembly enables external powering of a hearing device configured for inductive charging of a battery in the hearing device by using a charging coil/circuit of the hearing device or a separate power coil in the hearing device. Thus, the battery assembly provides an emergency power source or an external power source that the user can keep in his possession, e.g. in a wallet. If the user has forgotten to charge his hearing device, or the hearing device for any other reason runs out of power, the user may utilize the battery assembly for powering the hearing device until an inductive charging is again available. Further, the battery assembly is able to power the hearing device while the hearing device is in use and performs hearing compensation.

It is an important advantage that the user experience for a user using a rechargeable hearing aid or hearing device is greatly improved, by providing a an external power supply for e.g. emergency use, when the internal battery cannot feed power to the hearing device.

A battery assembly for powering a hearing device includes: a main part having at least a first surface and a second surface, the main part comprising a first electrode formed as an inductive coil; a first attachment member on at least a primary part of the first surface for attaching the main part to a hearing device housing of the hearing device; a second attachment member for attaching a direct current source to the main part; and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current.

Optionally, the main part comprises a sheet.

Optionally, the first attachment member comprises a first adhesive layer covering at least a part of the first surface or at least a part of the second surface.

Optionally, the battery assembly further includes a removable first protective sheet covering the first adhesive layer.

Optionally, the first adhesive layer is configured to adhere to the hearing device housing of the hearing device.

Optionally, the second attachment member comprises an electrically conductive adhesive layer electrically connected to the first input terminal and/or the second input terminal.

Optionally, the battery assembly further includes a protective sheet covering the adhesive layer.

Optionally, the battery assembly further includes the direct current source, the direct current source being a battery having a housing with one or more activation openings sealed with a battery activation tab or a part of the first surface.

Optionally, the battery assembly further includes an activation part between an input terminal of the electronic circuit and an output terminal of the direct current source.

Optionally, the main part comprises a printed circuit board.

Optionally, the main part comprises an elongated sheet having a first end and a second end, the elongated sheet having a length that is anywhere from 10 mm to 50 mm.

Optionally, the main part has a T-shape, a L-shape, an I-shape, or a cross-shape.

A method for powering a hearing device with a direct current source, includes: providing a battery assembly comprising a main part having at least a first surface and a second surface, the main part comprising a first electrode formed as an inductive coil, a first attachment member on at least a primary part of the first surface for attaching the main part to a hearing device housing of the hearing device, a second attachment member for attaching a direct current source to the main part, and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current. The method also includes: attaching the main part of the battery assembly to a direct current source; and activating the direct current source.

Optionally, the method further includes: attaching the battery assembly to the hearing device, wherein when the battery assembly is attached to the hearing device, the inductive coil of the battery assembly is aligned with an inductive coil of the hearing device.

Optionally, the act of attaching the battery assembly to the hearing device is performed using a first adhesive layer.

Other and further aspects and features will be evident from reading the following detailed description of the embodiments.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
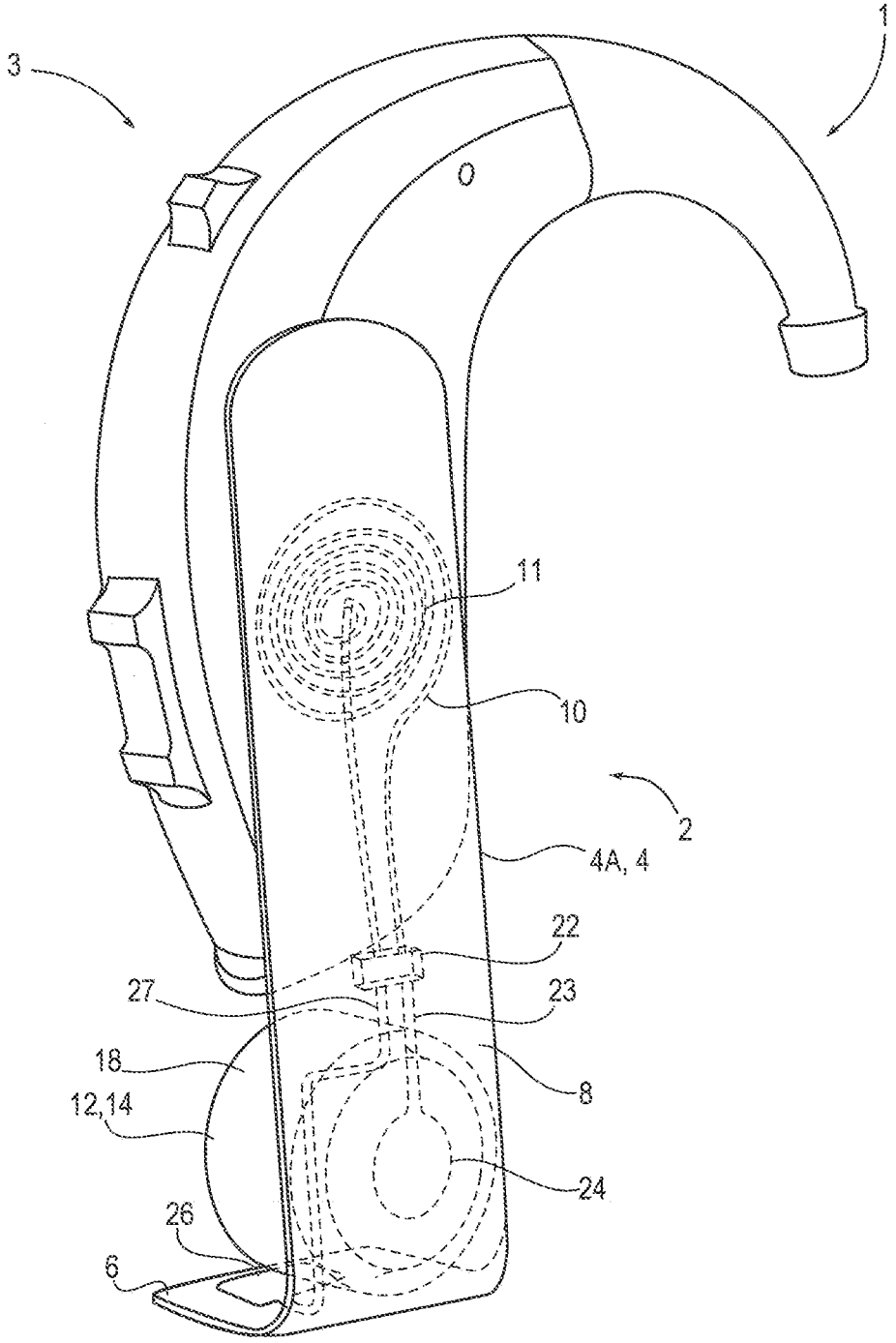
FIG. 1 schematically illustrates an exemplary hearing device with an exemplary battery assembly attached thereto.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The disclosed battery assembly enables a user to use a rechargeable hearing device even when the rechargeable battery in the hearing device runs out by providing a secondary power supply that is easy and convenient to use for a hearing device user.

The electronic circuit comprises a first input terminal or input node and a second input terminal or input node. The first input terminal is connected, connectable or configured to connect to a first output terminal of a direct current (DC) source, and the second input terminal is connected, connectable or configured to connect to a second output terminal of the DC source. The input terminals may be connectable or configured to connect to the DC source via a number of pads connected to the input terminals via input electrodes.

The electronic circuit comprises one or more output terminals or nodes including a first output terminal and optionally a second output terminal. First and second output terminals of the electronic circuit may be connected to respective ends or points of the first electrode forming an inductive coil.

The electronic circuit may comprise an oscillator for converting DC from the DC source to alternating current (AC). The oscillator may be configured to provide an output signal with a frequency in the range from 125 kHz to 15 MHz.

The battery assembly may comprise one or more first pads connected to the first input terminal of the electronic circuit via first input electrode(s).

The battery assembly may comprise one or more second pads connected to the second input terminal of the electronic circuit via second input electrode(s). The battery assembly may comprise a primary second pad, a secondary second pad and optionally a tertiary second pad each connected to the second input terminal via second input electrode(s). A pad facilitates electrical connection between an input terminal of the electronic circuit and an output terminal of the DC source for feeding power from the DC source to the electronic circuit.

The first attachment member may be a first adhesive layer or part. A first adhesive layer or part on a first surface of the battery assembly enables removable attachment of the battery assembly to a hearing device housing. The first adhesive layer may cover or at least partly cover the first inductive coil, e.g. for ensuring accurate and stable positioning of the inductive coil in relation to an inductive charging or power coil of the hearing device.

The first adhesive layer for attaching the battery assembly to a hearing device housing may be arranged on the first surface or a second surface of the main part.

The first attachment member may be the first adhesive layer.

The first attachment member may be a resilient spring clamp configured for fitting partially or completely around the hearing device housing of the hearing device.

The first attachment member may be an engagement member configured for engaging the hearing device housing and fitting partially or completely around the hearing device housing of the hearing device. The first attachment member may comprise an elastic band or strap.

The battery assembly may comprise one or more removable protective sheets, including a first protective sheet. The first protective sheet may cover or at least partly cover the first adhesive layer. The purpose of the removable first protective sheet may be that the user may handle the battery assembly without the first adhesive layer being exposed, and when the user wishes to attach the battery assembly to the hearing device, the first adhesive layer can be exposed by removal of the first protective sheet and the battery assembly can then be attached to the hearing device.

The direct current source may be any direct current source, such as a battery. The direct current source may be any type of battery. The battery may be of the same type as conventionally used in hearing devices, e.g. a zinc-air battery. The DC source may provide a supply voltage in the range from 1.1 V to 3 V.

Some batteries, e.g. zinc-air batteries, aluminum-air batteries or lithium-air batteries, rely on a reaction with oxygen, and may be activated by unsealing or revealing activation opening(s) to let air into the battery. Thus, the direct current source may be a battery having a housing with one or more activation openings. The one or more activation openings may be sealed with a battery activation tab. The one or more activation openings may alternatively or additionally be sealed and/or covered by a part of the main part, e.g. the primary part of the first surface with the first attachment member, such as the first adhesive layer.

In an exemplary battery assembly, the main part of the battery assembly may be in the form of a sheet. The battery assembly may also be configured for holding or attaching a DC source to the sheet or the battery assembly may comprise a DC source. The battery assembly may comprise one or more second attachment members for attaching the DC source to the battery assembly and/or providing electrical contact between pad(s) and output terminal(s) of the DC source.

The one or more second attachment members may include one or more second adhesive layers.

The second adhesive layer or second adhesive layers, such as a primary second adhesive layer and/or a secondary second adhesive layer may each be configured for electrically connecting a pad or an input terminal of the plurality of input terminals of the electronic circuit to an output terminal of the direct current source. Hence, the direct current source may be fixed to the battery assembly by the second adhesive layer(s). The primary second adhesive layer or the secondary second adhesive layer may be integrated in the first adhesive layer.

The second attachment member may be a battery seat or compartment with electrical connector members or pads connected to the first input terminal and the second input terminal, respectively. The battery seat or compartment may be configured for holding a battery or other DC source, e.g. in a press-fit engagement.

In exemplary battery assemblies, the second attachment member fix the direct current source to the battery assembly, e.g. the first and/or second output terminals of the direct current source is fixed to the battery assembly. For example, electrically conductive glue or other fastener, may be used for fixing the DC source to the battery assembly and forming electrical connections between respective output terminals and pads.

The battery assembly may comprise a plurality of removable protective sheets, including the removable first protective sheet and optionally removable second protective sheet(s).

The removable second protective sheet(s) may cover the second adhesive layer(s). Hence before use, the user may handle the battery assembly without exposing the second adhesive layer(s). When the direct current source is ready to be attached to the sheet and/or ready to be activated, the user may remove the second protective sheet, thereby exposing the second adhesive layer in order to affix an input terminal of the electronic circuit to an output terminal of the direct current source. A single protective sheet, e.g. the first protective sheet, may cover the first adhesive layer and the second adhesive layer(s).

The removable second protective sheet may include a plurality of removable second protective sheets, such as a primary second protective sheet, a secondary second protective sheet and/or a tertiary second protective sheet. Each of the plurality of removable second protective sheets may cover one of the plurality of second adhesive layers. Whether second protective sheets are employed depends on whether a DC source is pre-attached or not. One or more second protective sheets, e.g. all second protective sheets, are optional and may be dispensed with in case of a DC source being pre-attached to the battery assembly.

To allow an electrical connection between an input terminal of the electronic circuit and an output terminal of the direct current source, the second adhesive layer may be made of an electrically conducting material. Alternatively, the second adhesive layer(s) may leave a part of the input terminals/pads exposed, such that an electrical connection is possible even if the second adhesive layer is made of an electrically insulating material.

The battery assembly may comprise an activation part between an input terminal of the electronic circuit and an output terminal of the direct current source. The activation part may be an electrically insulating layer between an input terminal of the electronic circuit and an output terminal of the direct current source. Hence, unintentional discharging of the direct current source before use is avoided or at least limited.

In an exemplary battery assembly, the first adhesive layer may adhere to the direct current source. Hence, the first adhesive layer may be configured to adhere to the hearing device and to the direct current source. This may lower production costs, since a single adhesive layer, i.e. the first adhesive layer, can be applied to a substantial part of the first and/or second surface.

The first adhesive layer may be an adhesive that allows the battery assembly to be detached from the hearing device after use.

The second adhesive layer may be an adhesive that do not allow easy detachment. Hence, the second adhesive layer may prevent easy detachment of the direct current source from the battery assembly. This may be beneficial to ensure a firm connection between an input terminal of the electronic circuit and an output terminal of the direct current source, and to eliminate or at least limit the risk of the direct current source unintentionally detaching from the battery assembly.

The main part may be a printed circuit board. Hence, manufacturing is easy and production costs can be lowered. If the main part is embodied as a sheet, the sheet may be a printed circuit board.

The main part may be an elongated sheet having a first end and a second end. The sheet and/or the main part may have a length in the range from 10 mm to 50 mm.

The sheet and/or the main part may have a shape selected from T-shaped, L-shaped, I-shaped or cross-shaped. Different shapes may be beneficial for different purposes, and may further be a compromise between reliability and production costs.

The sheet and/or the main part may comprise one or more folding lines including a first folding line. One or more of the folding lines, e.g. the first folding line, may be configured to bring an input terminal of the electronic circuit in contact with an output terminal of the direct current source. In an exemplary battery assembly, the first folding line may be configured to bring the second input terminal in contact with the second output terminal.

The sheet and/or the main part may comprise a plurality of folding lines including the first folding line, a second folding line, a third folding line, a fourth folding line and/or a fifth folding line. In an exemplary battery assembly, the first folding line may be configured to bring a second primary input terminal in contact with the second output terminal, and a second folding line may be configured to bring a second secondary input terminal in contact with the second output terminal.

The direct current source and the sheet may be bundled together, or distributed individually. The battery assembly may be provided together with the direct current source. Alternatively, the battery assembly may be provided without the direct current source, and thus be configured to receive a direct current source.

Further, a method for powering a hearing device is disclosed. The method comprises: providing a battery assembly as described herein; optionally attaching the direct current source to the main part of the battery assembly; and activating the direct current source.

The method may further comprise attaching the battery assembly to the hearing device, e.g. to a hearing device housing of the hearing device.

Activating the DC source may comprise connecting one or more output terminals, e.g. the second output terminal and/or the first output terminal, of the DC source with a pad of the battery assembly.

Activating the DC source may comprise removing or peeling off a battery activation tab from the DC source.

Activating the DC source may comprise removing or peeling of one or more protective sheets of the battery assembly.

Attaching the battery assembly to the hearing device may comprise attaching the first attachment member to the hearing device housing.

Attaching the battery assembly to the hearing device may comprise aligning the first inductive coil with an inductive coil of the hearing device.

Attaching the battery assembly to the hearing device may comprise exposing a first adhesive layer, e.g. by removing a first protective sheet covering the first adhesive layer.

FIG. 1 schematically illustrates an exemplary hearing device system 1 comprising a hearing device 3 with an exemplary battery assembly 2 attached thereto. The battery assembly 2 comprises a main part 4A in the form of a sheet 4, an electronic circuit 22, and optionally a direct current source 12 attached to or attachable to the sheet 4. The DC source 12 has a first output terminal 16 and a second output terminal 18 and may be attached to the sheet during manufacture or by the user prior to attachment to a hearing device. A first attachment member (not shown), such as a first adhesive layer on at least a primary part of the first surface, affix the sheet/battery assembly to the hearing device 3.

The sheet 4 has a first surface 6 and a second surface 8 and comprises a first electrode 10 formed as an inductive coil 11.

The electronic circuit 22 has a first input terminal 23 and a second input terminal 27 that are connected to the direct current source 12 via first pad 24 and second pad 26. The electronic circuit 22 converts direct current from the direct current source 12 to alternating current in the inductive coil 11.

The alternating current in the inductive coil 11 generates an alternating magnetic field that induces electromagnetic power in an inductive coil (not shown) in the hearing device 3 when the inductive coil 11 of the battery assembly 2 is in close vicinity of the inductive coil in the hearing device 3.

The illustration in FIG. 1 depicts the battery assembly 2 with an attached direct current source 12, here exemplified as a button cell battery. The battery assembly 2 is attached to the hearing device 3 and creates an inductive coupling between the inductive coil 11 of the battery assembly 2 and an inductive coil (not shown) of the hearing device 3. Hence, the battery assembly 2 allows the direct current source 12 to power and/or charge the hearing device 3 via an inductive coupling.

A user may on a daily basis charge an internal battery of the hearing device 3. However, the internal battery (not shown) of the hearing device 3 may run out of power while no inductive charger is available, or the hearing device is in use. If the internal battery should run out of power, the battery assembly 2 can easily and conveniently be attached to the hearing device 3 as shown. The hearing device 3 is then able, via an inductive coupling, to be powered by power provided by the direct current source 12.

Figure 2:
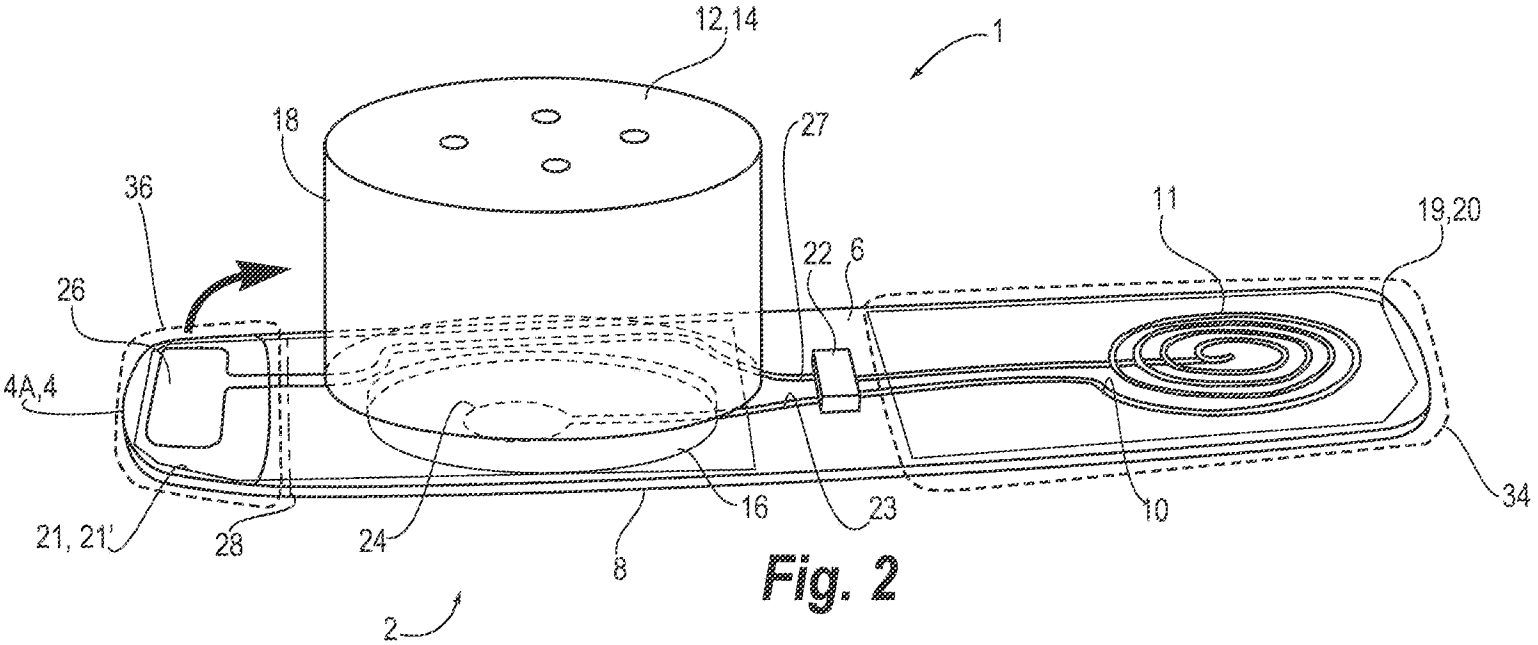
FIG. 2 schematically illustrates an exemplary battery assembly.

FIG. 2 schematically illustrates an exemplary battery assembly 2. The battery assembly comprises a main part 4A in the form of a sheet 4 and a direct current source 12. The direct current source 12 comprises a housing 14 and has a first output terminal 16 and a second output terminal 18.

The battery assembly 2 comprises an electronic circuit 22 having a first input terminal 23 and a second input terminal 27. The first input terminal 23 is connected to the first output terminal 16 of the direct current source 12 via a first pad 24. The first output terminal 16 is glued or fastened to the sheet 4 with an electrically conductive glue or other fastener, which attaches the DC source 12 to the sheet 4 and electrically connects the first pad 24 and the first output terminal 16. The second input terminal 27 is connectable to the second output terminal 18 of the direct current source 12 via second pad 26. The electronic circuit 22 is connected to the first pad 24 and second pad 26 for converting direct current from the direct current source 12 to alternating current in the inductive coil 11.

In FIG. 2, the second input terminal 27 is connected to the second output terminal 18 by performing a folding of the sheet 4 along a first folding line 28 as shown by the arrow. The battery assembly 2 in FIG. 2 comprises a first attachment member 19 in the form of a first adhesive layer 20 and a second attachment member 21' in the form of a second adhesive layer 21. The second adhesive layer 21 is adapted to adhere to the direct current source 12 and to electrically connect the second output terminal 18 and the second pad 26 by contact and/or via electrically conductive second adhesive layer 21.

A first protective sheet 34 covers and protects the first adhesive layer 20 prior to use. The first protective sheet 34 is removed when a user wishes to attach the battery assembly to a hearing device. A second protective sheet 36 covers and protects the second adhesive layer 21 prior to use. The second protective sheet 36 is removed when a user wishes to activate the battery assembly/DC source.

Figure 3:
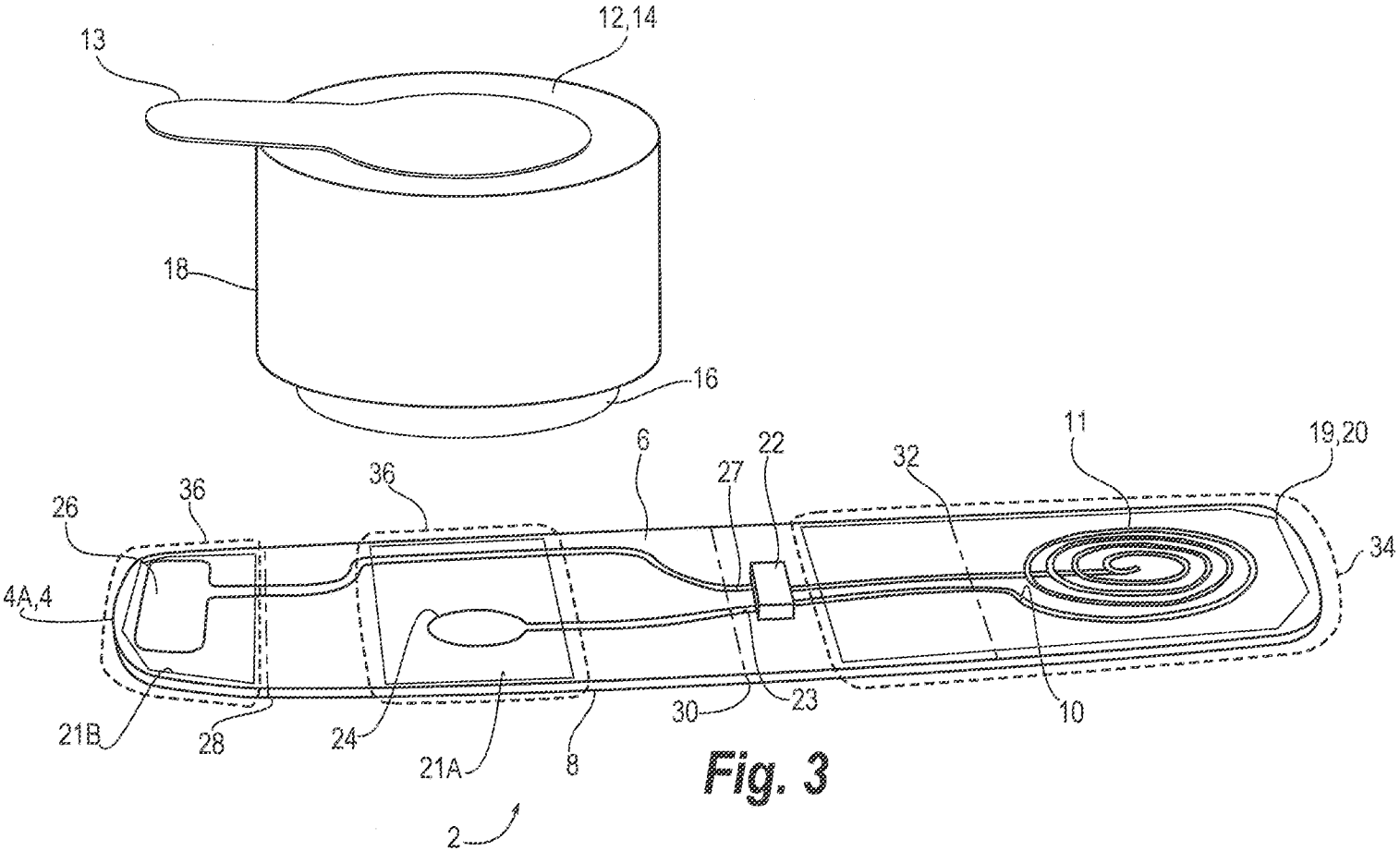
FIG. 3 schematically illustrates an exemplary battery assembly.

FIG. 3 schematically illustrates an exemplary battery assembly 2 with a main part 4A formed as an I-shaped sheet 4. The direct current source 12 is in FIG. 3 exemplified as a battery that is activated by air and comprises a battery activation tab 13 sealing one or more activation openings in the housing 14. Upon removal of the battery activation tab 13 air is allowed to enter the activation openings of the housing 14, thus activating the battery 12.

The battery assembly 2 comprises two second adhesive layers 21A and 21B configured for adhering the direct current source 12 to the sheet 4. Further, the primary second adhesive layer 21A electrically connects the first pad 24 and the first output terminal 16 of the battery 12, and the secondary second adhesive layer 21B electrically connects the second pad 26 and the second output terminal 18 of the battery 12.

Optionally, the sheet 4 has a second folding line 30 and/or a third folding line 32 to allow folding of the sheet 4 around the battery 12 to provide a more compact battery assembly with DC source.

Figure 4:
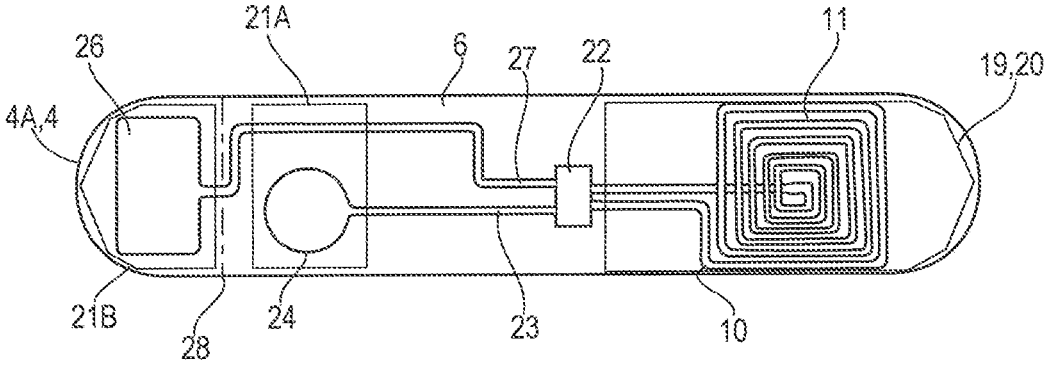
FIG. 4 schematically illustrates a exemplary battery assembly.
Figure 5:
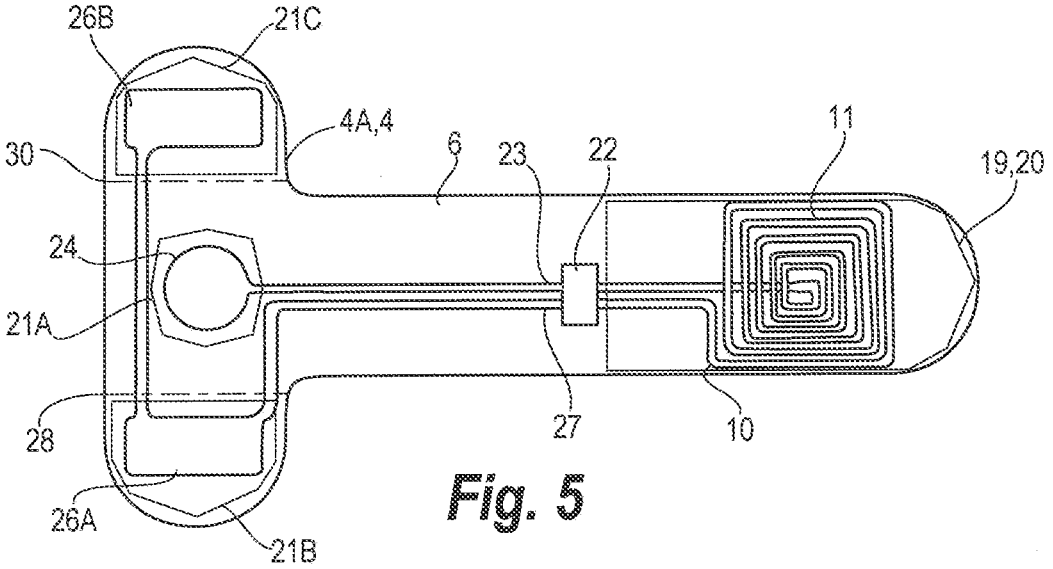
FIG. 5 schematically illustrates a exemplary battery assembly.
Figure 6:
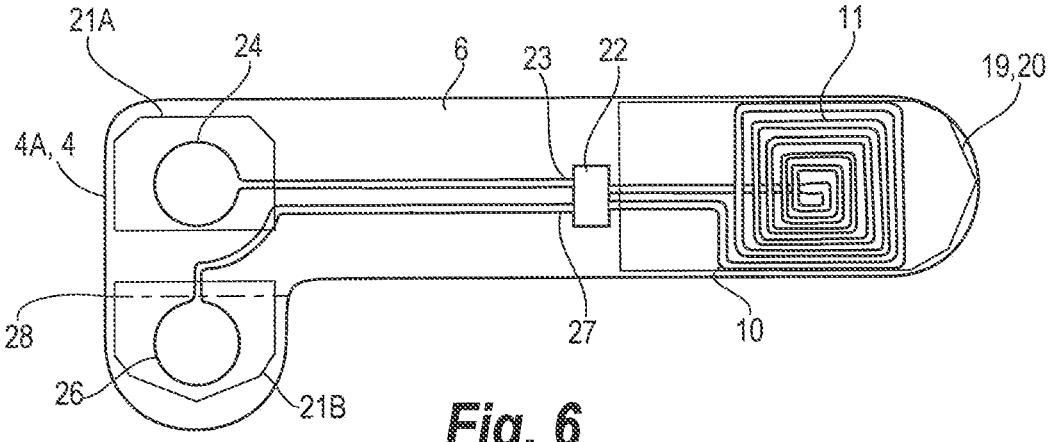
FIG. 6 schematically illustrates a exemplary battery assembly.

FIG. 4-6 schematically illustrates exemplary main parts 4A in the form of sheets 4 of different shapes but comprising similar functional features.

FIG. 4 shows an exemplary sheet 4 comparable to the sheet as explained in relation to FIG. 3, wherein the initial shape of the sheet 4 is I-shaped. The first folding line 28 guides a folding along a line perpendicular to a longitudinal direction of the sheet 4.

FIG. 5 shows an exemplary sheet 4 wherein the initial shape of the sheet 4 is T-shaped. The sheet 4 comprises a first folding line 28 and a second folding line 30. Further, the sheet 4 as illustrated in FIG. 5 comprises a primary second pad 26A and a secondary second pad 26B. The first folding line 28 allows the primary second pad 26A to connect to a second output terminal of an attached direct current source. The second folding line 30 allows the secondary second pad 26B to connect to a second output terminal of an attached direct current source.

The sheet 4 as illustrated in FIG. 5 comprises a plurality of second adhesive layers 21A, 21B, 21C including a primary second adhesive layer 21A, a secondary second adhesive layer 21B and a tertiary second adhesive layer 21C. The plurality of second adhesive layers 21A, 21B, 21C allow each of the first pad 24, primary second pad 26A and secondary second pad 26B, respectively, to adhere to a direct current source 12.

The first folding line 28 and the second folding line 30 as illustrated in FIG. 5, guides a folding of the sheet 4 along a line parallel to a longitudinal direction of the sheet 4.

FIG. 6 shows an exemplary sheet 4 wherein the initial shape of the sheet 4 is L-shaped. The sheet 4 comprises a first folding line 28, wherein the first folding line 28 guides a folding of the sheet along a line parallel to a longitudinal direction of the sheet 4.

Figure 7:
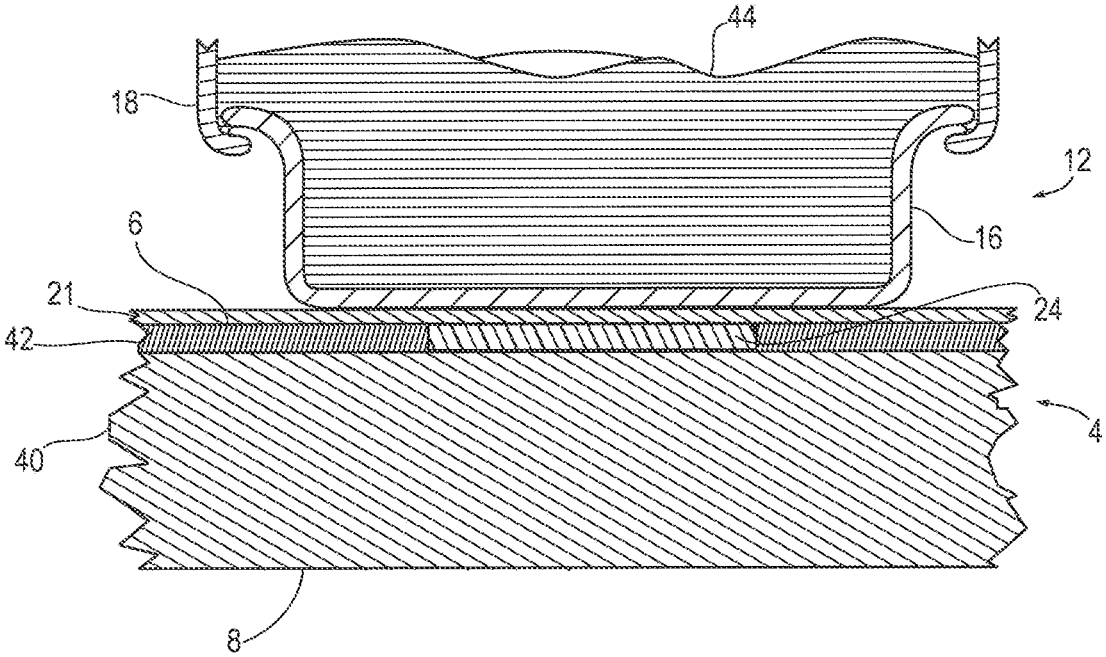
FIG. 7 schematically illustrates an interface between a direct current source and a sheet.

FIG. 7 schematically shows an exemplary interface between a direct current source 12 and the sheet 4. The direct current source 12 comprises a first output terminal 16 and a second output terminal 18. Further, the direct current source 12 encloses an electrolyte 44. The sheet 4 has a base layer 40 and a non conductive layer 42 with a first surface 6 and a second surface 8. A primary second adhesive layer 21 on the first surface 6 electrically connects the first pad 24 and the first terminal 16.

Figure 8:
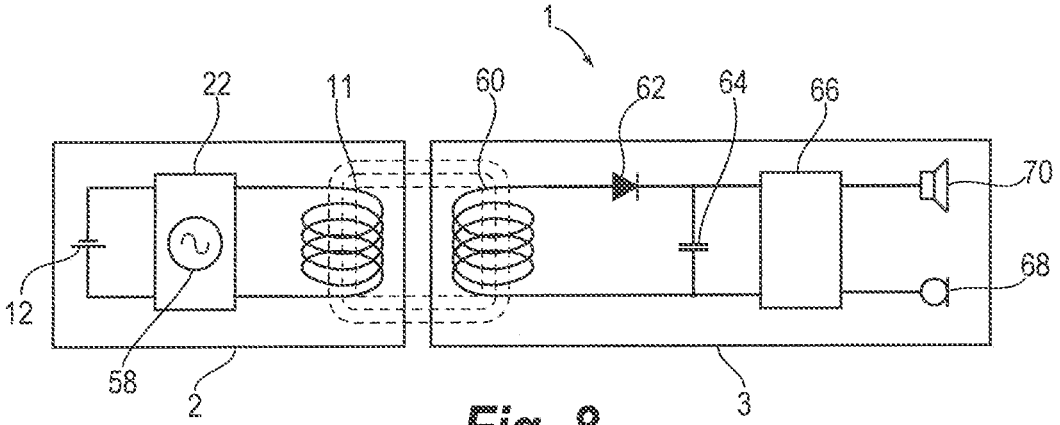
FIG. 8 schematically illustrates an exemplary hearing device with an exemplary battery assembly attached thereto.

FIG. 8 schematically shows an inductive coupling between a battery assembly 2 and a hearing device 3. The battery assembly 2 comprises a direct current source 12, an electronic circuit 22 and an inductive coil 11. The electronic circuit 22 comprises an oscillator 58 that converts the direct current from the direct current source 12 to an alternating current which induces an alternating electromagnetic field in the inductive coil 11. The hearing device 3 comprises an inductive coil 60, a diode 62, a capacitor circuit 64, a processing unit 66, a microphone 68 and a receiver 70. The inductive coil 11 induces an alternating electromagnetic field in the inductive coil 60 of the hearing device 3 giving rise to an alternating current. The alternating current thus produced by the inductive coil 60 of the hearing device 3 is rectified by the diode 62 and capacitor circuit 64 and a direct current is fed to the functional parts of the hearing device 3, effectively powering the hearing device circuit, here illustrated as being fed to the processing unit 66.

Figure 9:
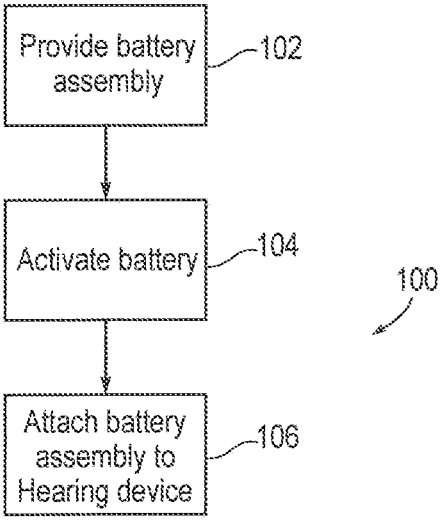
FIG. 9 is a flow diagram of an exemplary method in accordance with some embodiments.

FIG. 9 illustrates a flow-diagram of a method of powering a hearing device 100. The method 100 comprises providing a battery assembly with a direct current source 102, activating the direct current source 104 and attaching the battery assembly to the hearing device housing 106. The battery assembly provided may be a battery assembly as described herein and in particular in relation to FIGS. 1-8.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES 1 hearing device system
2 battery assembly
3 hearing device
4A main part
4 sheet
6 first surface
8 second surface
10 first electrode
11 inductive coil
12 direct current source
13 battery activation tab
14 housing
16 first output terminal
18 second output terminal
19 first attachment member
20 first adhesive layer
21' second attachment member
21 second adhesive layer
21A primary second adhesive layer
21B secondary second adhesive layer
21C tertiary second adhesive layer
22 electronic circuit
23 first input terminal
24 first pad
26 second pad
26A primary second pad
26B second secondary pad
27 second input terminal
28 first folding line
30 second folding line
32 third folding line
34 first protective sheet
36 second protective sheet
40 sheet base layer
42 non-conductive layer
44 electrolyte
58 oscilllator
60 inductive coil
62 diode
64 capacitor circuit
66 processing unit
68 microphone
70 receiver
100 method of powering a hearing device
102 providing battery assembly
104 activating direct current source
106 attach battery assembly to hearing device

The invention claimed is:

1. A battery assembly for powering a hearing device, the battery assembly comprising:

a main part having at least a first surface and a second surface, the main part comprising a first electrode formed as an inductive coil;

a first attachment member on at least a primary part of the first surface for attaching the main part to a hearing device housing of the hearing device;

a second attachment member for attaching a direct current source to the main part; and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current.

2. The battery assembly according to claim 1, wherein the main part comprises a sheet.

3. The battery assembly according to claim 1, wherein the first attachment member comprises a first adhesive layer covering at least a part of the first surface or at least a part of the second surface.

4. The battery assembly according to claim 3, further comprising a removable first protective sheet covering the first adhesive layer.

5. The battery assembly according to claim 3, wherein the first adhesive layer is configured to adhere to the hearing device housing of the hearing device.

6. The battery assembly according to claim 1, further comprising the direct current source, the direct current source being a battery having a housing with one or more activation openings sealed with a battery activation tab or a part of the first surface.

7. The battery assembly according to claim 1, further comprising an activation part between an input terminal of the electronic circuit and an output terminal of the direct current source.

8. The battery assembly according to claim 1, wherein the main part comprises a printed circuit board.

9. The battery assembly according to claim 1, wherein the main part comprises an elongated sheet having a first end and a second end, the elongated sheet having a length that is anywhere from 10 mm to 50 mm.

10. The battery assembly according to claim 1, wherein the main part has a T-shape, a L-shape, an I-shape, or a cross-shape.

11. The battery assembly according to claim 1, wherein the first attachment member is configured to attach the main part to only one side of the hearing device housing.

12. The battery assembly according to claim 1, wherein the first attachment member is configured to attach the main part to the hearing device housing such that the hearing device housing can carry the first attachment member.

13. A battery assembly for powering a hearing device, the battery assembly comprising:

a main part having at least a first surface and a second surface, the main part comprising a first electrode formed as an inductive coil;

a first attachment member on at least a primary part of the first surface for attaching the main part to a hearing device housing of the hearing device;

a second attachment member for attaching a direct current source to the main part; and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current;

wherein the second attachment member comprises an electrically conductive adhesive layer electrically connected to the first input terminal and/or the second input terminal.

14. A battery assembly for powering a hearing device, the battery assembly comprising:

a main part having at least a first surface and a second surface, the main part comprising a first electrode formed as an inductive coil;

a first attachment member on at least a primary part of the first surface for attaching the main part to a hearing device housing of the hearing device;

a second attachment member for attaching a direct current source to the main part; and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current;

wherein the second attachment member comprises an electrically conductive adhesive layer electrically connected to the first input terminal and/or the second input terminal; and wherein the battery assembly further comprises a protective sheet covering the electrically conductive adhesive layer.

15. A method for powering a hearing device with a direct current source, the method comprising:

providing a battery assembly comprising a main part having at least a first surface and a second surface, the main part comprising a first electrode formed as an inductive coil, a first attachment member on at least a primary part of the first surface for attaching the main part to a hearing device housing of the hearing device, a second attachment member for attaching a direct current source to the main part, and an electronic circuit having a first input terminal and a second input terminal connectable to a first output terminal and a second output terminal, respectively, of the direct current source, wherein the electronic circuit is connected to the first electrode, and wherein the electronic circuit is configured for converting direct current from the direct current source to alternating current;

attaching the main part of the battery assembly to a direct current source; and activating the direct current source.

16. The method according to claim 15, further comprising:

attaching the battery assembly to the hearing device, wherein when the battery assembly is attached to the hearing device, the inductive coil of the battery assembly is aligned with an inductive coil of the hearing device.

17. The method according to claim 16, wherein the act of attaching the battery assembly to the hearing device is performed using a first adhesive layer.

* * * * *